US010845118B2

(12) United States Patent
Golubev

(10) Patent No.: US 10,845,118 B2
(45) Date of Patent: Nov. 24, 2020

(54) DISTILLATION COLUMN SYSTEM AND PLANT FOR PRODUCTION OF OXYGEN BY CRYOGENIC FRACTIONATION OF AIR

(71) Applicant: LINDE AKTIENGESELLSCHAFT, Munich (DE)

(72) Inventor: Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 831 days.

(21) Appl. No.: 15/234,302

(22) Filed: Aug. 11, 2016

(65) Prior Publication Data

US 2017/0051971 A1 Feb. 23, 2017

(30) Foreign Application Priority Data

Aug. 20, 2015 (EP) ..... 15002477

(51) Int. Cl.
*F25J 3/04* (2006.01)

(52) U.S. Cl.
CPC ..... *F25J 3/04678* (2013.01); *F25J 3/048* (2013.01); *F25J 3/0409* (2013.01); *F25J 3/04024* (2013.01); *F25J 3/04084* (2013.01); *F25J 3/04157* (2013.01); *F25J 3/04169* (2013.01); *F25J 3/04296* (2013.01); *F25J 3/04303* (2013.01); *F25J 3/04387* (2013.01); *F25J 3/04393* (2013.01); *F25J 3/04412* (2013.01); *F25J 3/04672* (2013.01); *F25J 3/04703* (2013.01); *F25J 3/04818* (2013.01); *F25J 3/04896* (2013.01); *F25J 3/04909* (2013.01); *F25J 3/04921* (2013.01); *F25J 3/04939* (2013.01); *F25J 3/04963* (2013.01); *F25J 2200/54* (2013.01); *F25J 2200/72* (2013.01); *F25J 2205/02* (2013.01); *F25J 2205/60* (2013.01); *F25J 2205/84* (2013.01); *F25J 2230/02* (2013.01); *F25J 2230/40* (2013.01); *F25J 2240/10* (2013.01); *F25J 2240/40* (2013.01); *F25J 2240/48* (2013.01); *F25J 2245/02* (2013.01); *F25J 2245/42* (2013.01); *F25J 2245/58* (2013.01);
(Continued)

(58) Field of Classification Search
CPC ..... F25J 3/048; F25J 3/0486; F25J 3/04666; F25J 3/04672; F25J 3/04703; F25J 3/04412; F25J 3/0443
See application file for complete search history.

(56) References Cited

U.S. PATENT DOCUMENTS 5,355,681 A 10/1994 Xu
6,240,744 B1 6/2001 Agrawal et al.

FOREIGN PATENT DOCUMENTS

DE 1 272 322 B 7/1968
EP 2 865 978 A1 4/2015
JP S57 134596 U 8/1982

*Primary Examiner* — John F Pettitt, III
(74) *Attorney, Agent, or Firm* — Millen White Zelano & Branigan, PC; Brion P. Heaney

(57) ABSTRACT

A distillation column system and a plant are for production of oxygen by cryogenic fractionation of air. The distillation column system has a high-pressure column and a low-pressure column, a main condenser, and an argon column with an argon column top condenser. The low-pressure column comprises an upper mass transfer region, a lower mass transfer region and a middle mass transfer region. The argon column top condenser is arranged within the low-pressure column between the upper and middle mass transfer regions and is configured as a forced-flow evaporator.

20 Claims, 12 Drawing Sheets

(52) U.S. Cl.
CPC ..... *F25J 2250/02* (2013.01); *F25J 2250/04* (2013.01); *F25J 2270/02* (2013.01); *F25J 2270/90* (2013.01); *F25J 2290/12* (2013.01)

DISTILLATION COLUMN SYSTEM AND PLANT FOR PRODUCTION OF OXYGEN BY CRYOGENIC FRACTIONATION OF AIR

CROSS REFERENCE TO RELATED APPLICATIONS

This application claims priority from European Application EP 15002477.6-160 filed on Aug. 20, 2015.

BACKGROUND OF THE INVENTION

The invention relates to a distillation column system for production of oxygen by cryogenic fractionation of air comprising

- a high-pressure column and a low-pressure column,
- a main condenser configured as a condenser-evaporator, the liquefaction space of the main condenser being in flow connection with the top of the high-pressure column,
- and comprising an argon column which
- is in flow connection with an intermediate point in the low-pressure column, and
- has means of drawing off an argon-enriched stream and
- an argon column top condenser which is configured as a condenser-evaporator and is in flow connection with the top of the argon column,
- the low-pressure column has an upper mass transfer region, a lower mass transfer region and a middle mass transfer region,
- the middle mass transfer region has at least one first mass transfer space which is open in the upward direction toward the upper mass transfer region and in the downward direction toward the lower mass transfer region.

The basics of cryogenic fractionation of air in general and specifically the construction of two-column plants are described in the monograph "Tieftemperaturtechnik" [Cryogenic Technology] by Hausen/Linde (2nd edition, 1985) and in an article by Latimer in Chemical Engineering Progress (vol. 63, No. 2, 1967, page 35). The heat exchange relationship between high-pressure column and low-pressure column of a twin column is generally accomplished by means of a main condenser in which top gas from the high-pressure column is liquefied against evaporating bottoms liquid from the low-pressure column.

The distillation column system of the invention can in principle be configured as a conventional two-column system with high-pressure column and low-pressure column. In addition to the two separation columns for nitrogen-oxygen separation, it may additionally include further devices for obtaining other air components, especially noble gases, for example a krypton-xenon recovery.

The main condenser in the invention is referred to as condenser-evaporator. A "condenser-evaporator" refers to a heat exchanger in which a first condensing fluid stream enters into indirect heat exchange with a second evaporating fluid stream. Every condenser evaporator has a liquefaction space and an evaporation space consisting of liquefaction passages and evaporation passages respectively. In the liquefaction space the condensation (liquefaction) of the first fluid stream is conducted, and in the evaporation space the evaporation of the second fluid stream. The evaporation space and liquefaction space are formed by groups of passages that are in a heat exchange relationship with one another.

Typically, the main condenser is configured as a bath evaporator, especially as a cascade evaporator (for example as described in EP 1287302 B1=U.S. Pat. No. 6,748,763 B2). It may be formed by a single heat exchanger block or else by a plurality of heat exchanger blocks arranged in a common pressure vessel.

An "argon discharge column" refers here to a separation column for argon-oxygen separation which does not serve to recover a pure argon product, but serves to discharge argon from the air which is being fractionated in the high-pressure column and low-pressure column. The way in which it is connected differs only slightly from that of a conventional crude argon column, which generally has 70 to 180 theoretical plates; however, it contains far fewer theoretical plates, namely fewer than 40, especially between 15 and 35. Like a crude argon column, the bottom region of an argon discharge column is connected to an intermediate point in the low-pressure column, and the argon discharge column is typically cooled by a top condenser wherein expanded bottoms liquid from the high-pressure column is introduced on the evaporation side; an argon discharge column generally does not have a reboiler.

The expression "argon column" is used here as an umbrella term for argon discharge columns, full-scope crude argon columns and all intermediate stages in between.

The distillation column system of any fractionation plant is arranged in one or more coldboxes. A "coldbox" is understood here to mean an insulating shell encompassing a heat-insulated interior entirely with outer walls; arranged within the interior are plant components to be insulated, for example one or more separation columns and/or heat exchangers. The insulating effect can be brought about by appropriate configuration of the outer walls and/or by the filling of the intermediate space between plant components and outer walls with an insulating material. In the latter variant, preference is given to using a pulverulent material, for example perlite. Both the distillation column system for nitrogen-oxygen separation of a cryogenic air fractionation plant and the main heat exchanger, and further cold plant components have to be enclosed by one or more coldboxes. The outer dimensions of the coldbox typically determine the transport dimensions of the package in the case of prefabricated plants.

A "main heat exchanger" serves to cool down feed air in indirect heat exchange with return flows from the distillation column system. It may be formed from one single or more than one parallel- and/or series-connected heat exchanger sections, for example from one or more plate heat exchanger blocks. Separate heat exchangers which serve specifically for evaporation or pseudo-evaporation of a single liquid or supercritical fluid, without partial heating and/or evaporation of a further fluid, do not form part of the main heat exchanger. Such a separate heat exchanger may be formed, for example, by a secondary condenser or by a separate heat exchanger for evaporation or pseudo-evaporation of a liquid stream at elevated pressure. Some air fractionation plants contain, for example, in addition to the main exchanger, a secondary condenser or a high-pressure exchanger for evaporation or pseudo-evaporation of product which has been pressurized in liquid form against a high-pressure air stream which is formed by a portion of the feed air.

The relative spatial terms "top", "bottom", "over", "under", "above", "below", "vertical", "horizontal", etc. relate to the spatial alignment of the apparatuses in normal operation.

A distillation column system of the type specified at the outset is known from U.S. Pat. No. 5,235,816. Plants of this kind, in production, are regularly prefabricated as far as possible, and the prefabricated components are transported to the construction site and finally connected to one another there. According to the size of the plant, for example, the entire double column may be transported together with its coldbox. If the size of the plant does not permit this, the double column is transported—in two parts if appropriate—without the coldbox and piping. An additional column such as the argon column causes additional complexity with a separate coldbox. This column is brought separately to the construction site and connected there to the rest of the plant on site with a relatively high level of complexity. In order to avoid an additional cryogenic pump, this column (in its own coldbox) is positioned on a complex frame. This frame causes, inter alia, an increased footprint for the entire plant.

FIG. 1 of EP 1108965 A1 discloses an argon column which has been installed in the low-pressure column and which has a top condenser arranged outside the low-pressure column.

SUMMARY OF THE INVENTION

It is an object of the invention to configure a distillation column system of the type specified at the outset with maximum compactness, to simplify its construction and to find a particularly operationally reliable control method.

This object is achieved by a distillation column system for obtaining oxygen by cryogenic fractionation of air, comprising

- a high-pressure column and a low-pressure column,
- a main condenser configured as a condenser-evaporator, the liquefaction space of the main condenser being in flow connection with the top of the high-pressure column,
- and comprising an argon column which
- is in flow connection with an intermediate point in the low-pressure column, and
- has means of drawing off an argon-enriched stream and
- an argon column top condenser which is configured as a condenser-evaporator and is in flow connection with the top of the argon column,
- the low-pressure column has an upper mass transfer region, a lower mass transfer region and a middle mass transfer region,
- the middle mass transfer region has at least one first mass transfer space which is open in the upward direction toward the upper mass transfer region and in the downward direction toward the lower mass transfer region, characterized in that
- the upper mass transfer region has a liquid collector at its bottom end,
- the first mass transfer space has a liquid distributor at its top,
- the argon column top condenser is arranged within the low-pressure column between the upper and middle mass transfer regions, and in that
- the argon column top condenser is configured as a forced-flow evaporator, having an evaporation space which has an inlet at its bottom end and an outlet at its top end, and the outlet being connected to the liquid distributor of the first mass transfer space, the system further including
- means of introducing liquid from the liquid collector beneath the upper mass transfer region into the inlet of the evaporation space of the argon column top condenser, and
- a vessel, a two-phase conduit which is connected to the outlet of the evaporation space of the argon condenser and to the inlet of the vessel, a gas conduit for drawing off gas from the vessel and containing a control valve, and a liquid conduit for introducing liquid from the vessel into the liquid distributor at the top of the middle mass transfer section.

According to this, the argon column top condenser is arranged within the low-pressure column. The argon discharge top condenser is configured as a forced-flow (once-through) evaporator; at the upper end thereof, the evaporation space is connected to the interior of the low-pressure column, such that the gas produced therein can flow into the upper mass transfer region. The argon column top condenser, in the invention, need not be arranged in the middle above the argon column (if the argon column is wholly or partly installed in the low-pressure column); instead, it is possible to utilize the entire cross section of the low-pressure column.

In a forced-flow evaporator, a liquid stream is forced through the evaporation space under its own pressure and partially evaporated therein. This pressure is generated, for example, by means of a liquid column in the inlet conduit to the evaporation space. The height of this liquid column corresponds to the pressure drop in the evaporation space. The gas-liquid mixture leaving the evaporation space, separated by phases, is guided directly onward to the next method step and, more particularly, is not introduced into a liquid bath of the condenser-evaporator from which the proportion remaining in liquid form is aspirated again ("once through").

A liquid is partly evaporated in the evaporation space of the forced-flow evaporator. The biphasic mixture flowing out of the outlet is preferably introduced into a liquid distributor at the top of the middle mass transfer region. The evaporated fraction flows upward into the upper mass transfer region; the fraction remaining in liquid form forms at least part of the reflux for at least part of the middle mass transfer region, which especially forms the argon section of the low-pressure column.

In principle, the forced-flow evaporator could, as in standard argon methods, be operated exclusively with the crude oxygen from the high-pressure column. In the context of the invention, however, it has been found to be more favourable to charge the evaporation space of the argon column top condenser with a liquid which comes from the upper mass transfer region of the low-pressure column. For this purpose, the liquid collector is connected below the upper mass transfer region to means of introducing liquid from the liquid collector via the inlet into the evaporation space of the argon column top condenser. Liquid running off from the upper mass transfer section is combined in the liquid collector and introduced, for example, via a conduit into the evaporation space of the argon column top condenser. The liquid thus serves to cool the top of the argon column. It is more oxygen-rich than the crude oxygen from the high-pressure column and hence enables a smaller temperature differential and correspondingly smaller thermodynamic losses in the argon column top condenser.

According to the invention ("control method 3"), the biphasic mixture from the evaporation space of the argon condenser is introduced into a vessel which acts as phase separation unit and liquid buffer. The liquid separated out in the vessel is guided into the liquid distributor beneath. The liquid volume is controlled by means of a fixed diaphragm or corresponding hole(s) in the base of the vessel or by means of a control valve in the liquid conduit. Gas is drawn off from the vessel via a gas conduit. The conduit contains a control valve, by means of which the pressure in the evaporation space is adjusted, and hence the temperature differential in the argon condenser and its performance.

In principle, it would be possible, rather than the forced-flow condenser, to use a falling-film evaporator as well, in which case all or almost all the liquid that flows downward in the upper mass transfer section likewise flows through the evaporation space of said falling-film evaporator.

DE 1272322 B discloses installing a crude argon column into the low-pressure column by means of a cylindrical dividing wall; the top condenser is configured as a conventional bath evaporator and a first portion thereof is arranged in the low-pressure column. In addition, a further vessel is utilized here for the second portion of the top condenser.

Preferably, in the invention, the argon condenser is configured such that it produces the entire reflux stream for the argon column. There is thus no further argon condenser that would be arranged outside the low-pressure column.

In general, the argon column is configured as an argon discharge column. If an argon product is required, however, it can also be configured as a crude argon column where an oxygen-depleted or oxygen-free crude argon product is obtained at the top. The crude argon product is either conducted away or sent to further workup in a pure argon column.

In a further development of the invention, the argon column or a portion thereof is also arranged within the low-pressure column, specifically in the middle mass transfer region. For this purpose, the latter is configured as a dividing wall section, meaning that it contains a vertical dividing wall which divides the argon section of the low-pressure column ("first mass transfer space") from the argon column ("second mass transfer space"). The first mass transfer space is open in the upward direction toward the upper mass transfer region and in the downward direction toward the lower mass transfer region. This means that ascending gas can flow without significant hindrance into the first mass transfer space at the bottom and out of the first mass transfer space at the top.

The second mass transfer space is sealed in a gas-tight manner in the upward direction toward the upper mass transfer region. The gas flowing in at the bottom from the lower mass transfer region is thus, after the rectification in the second mass transfer space (in the argon column), not introduced back into the low-pressure column but guided onward via one or more specific gas conduits and/or introduced into the liquefaction space of the argon column top condenser.

If only part of the argon column is arranged within the low-pressure column, the argon column also has a separate crude argon column outside the low-pressure column.

In one embodiment of the invention, the second mass transfer space is open in the downward direction toward the lower mass transfer region. The ascending gas from the lower mass transfer region thus flows into the second mass transfer and is subjected to an argon-oxygen separation therein.

Alternatively, the second mass transfer space is closed in the downward direction toward the lower mass transfer region, such that a different concentration can exist in the lower region of the second mass transfer space than at the upper end of the lower mass transfer region. Thus, the "upper" portion, viewed in terms of rectification, of an argon column may be incorporated into the dividing wall section, while the rest of the argon column, which is connected to the low-pressure column at the lower end, is implemented separately.

For full-scope argon production, it is possible to add a separate crude argon column. In that case, the argon column consists of the combination of crude argon column and second mass transfer space, it being possible to connect the second mass transfer space, in terms of rectification, to the upper or lower end of the crude argon column. In either case, the top of the argon column is in flow connection with the liquefaction space of the argon column top condenser. If the low-pressure column does not contain a dividing wall section, the argon column is formed exclusively by a separate crude argon column. In that case, this is connected in a customary manner, in that the head of the argon column is in flow connection with the liquefaction space of the argon column top condenser and the bottom of the argon column is in flow connection with an intermediate region of the low-pressure column, especially with the region between the middle and lower mass transfer region.

It is also advantageous when the means of introducing liquid from the liquid collector into the evaporation space of the argon column top condenser are configured for introduction of at least 80 mol %, preferably at least 90 mol %, of the volume of liquid that flows into the liquid collector in normal operation into the evaporation space of the argon column top condenser.

In the context of the invention, in normal operation of the plant, as close as possible to 100% of the liquid from the liquid collector should be introduced into the evaporation space.

Preferably, a crude oxygen conduit is provided for introduction of crude oxygen from the bottom of the high-pressure column into the upper mass transfer region of the low-pressure column; alternatively, the crude oxygen can be fed directly into the liquid collector upstream of the evaporation space. In the case of introduction into the low-pressure column, this introduction—which is customary per se—of bottoms liquid from the high-pressure column into the low-pressure column is not conducted via the argon column top condenser but directly into the upper mass transfer region. The liquid which is introduced into the evaporation space of the argon column top condenser is thus oxygen-richer than in the conventional method because the liquid collected below the upper section is being used here.

In one embodiment, the distillation column system has a bypass conduit for introduction of liquid from the liquid collector arranged below the upper mass transfer section into the liquid distributor at the top of the lower mass transfer section, with a control valve disposed in the bypass conduit.

By means of this bypass conduit, outside the scope of the invention, the performance of the argon column top condenser can be controlled. If appropriate, the control valve is opened, and a small amount of relatively nitrogen-rich liquid flows directly into the distributor and hence bypasses the middle mass transfer section. As a result, the nitrogen content in the liquefaction space of the argon top condenser (or in the biphasic mixture at the outlet) is increased, the mean condensation temperature drops and the performance of the condenser is reduced as a result of reduction in the driving temperature difference (control method 1).

As an alternative to the control according to the invention, it would also be possible to control the conversion in the crude argon column with the aid of a valve in the gas flow upstream of the crude argon condenser. In this case, a gas inlet is utilized for introduction of gas from the argon column into the liquefaction space of the argon column top condenser, and contains a control valve (control method 2).

The gas inlet immediately downstream of the control valve can be connected to a start-up conduit configured for controlled removal of gas from the low-pressure column.

The start-up conduit is connected to the gas inlet outside the vessel wall and is used only when the plant is cold-started. It contains a control valve which is closed in steady-state operation. It is necessary here, on start-up, to make sure that the mass transfer spaces are cooled equally on either side of the dividing wall. Large temperature differences between these two sections should be avoided in order thus to minimize the load on the dividing wall through thermally induced stresses. The start-up conduit is either open to the air or is connected to an impure nitrogen conduit upstream of the main heat exchanger. According to the temperature to the right and left of the dividing wall, the control valve is opened to a greater or lesser degree on start-up. It is advantageous that no separate stub has to be provided on the column here for the start-up conduit; instead, the start-up conduit is incorporated directly into the gas inlet downstream of the control valve for the argon column top condenser—i.e. outside the column. This start-up technique can be utilized not just in the invention, but in principle in the case of a dividing wall column section with a condenser above it.

The invention also relates to a plant for production of nitrogen by low-temperature fractionation of air comprising a main air compressor, an air precooling unit, an air cleaning unit and the main heat exchanger, and comprising two of the above-described distillation column systems, both of which receive feed air from the common main heat exchanger.

The plant for production of oxygen by cryogenic fractionation of air, comprises a main air compressor for compression of feed air, an air precooling unit for precooling of the feed air compressed in the main air compressor, an air cleaning unit for cleaning of the precooled feed air, a main heat exchanger for cooling of cleaned feed air, a first distillation column system for obtaining oxygen by cryogenic fractionation of air, comprising a high-pressure column and a low-pressure column, a main condenser configured as a condenser-evaporator, the liquefaction space of the main condenser being in flow connection with the top of the high-pressure column, and comprising an argon column which is in flow connection with an intermediate point in the low-pressure column, and has means of drawing off an argon-enriched stream and an argon column top condenser which is configured as a condenser-evaporator and is in flow connection with the top of the argon column, the low-pressure column has an upper mass transfer region, a lower mass transfer region and a middle mass transfer region, the middle mass transfer region has at least one first mass transfer space which is open in the upward direction toward the upper mass transfer region and in the downward direction toward the lower mass transfer region, characterized in that the upper mass transfer region has a liquid collector at its bottom end, the first mass transfer space has a liquid distributor at its top, the argon column top condenser is arranged within the low-pressure column between the upper and middle mass transfer regions, and in that the argon column top condenser is configured as a forced-flow evaporator, having an evaporation space which has an inlet at its bottom end and an outlet at its top end, and the outlet being connected to the liquid distributor of the first mass transfer space, the system further including means of introducing liquid from the liquid collector beneath the upper mass transfer region into the inlet of the evaporation space of the argon column top condenser, and a vessel, a two-phase conduit which is connected to the outlet of the evaporation space of the argon condenser and to the inlet of the vessel, a gas conduit for drawing off gas from the vessel and containing a control valve, and a liquid conduit for introducing liquid from the vessel into the liquid distributor at the top of the middle mass transfer section;

a second distillation column system configured according to the first distillation column system, a first compressed air substream conduit for introducing cooled feed air from the main heat exchanger into the high-pressure column of the first distillation column system and comprising a second compressed air substream conduit for introducing cooled feed air from the main heat exchanger into the high-pressure column of the second distillation column system.

In this case, at least a portion of the feed air for the two distillation column systems can be cooled together in the main heat exchanger and be drawn off from the main heat exchanger in a combined compressed air conduit. The combined compressed air conduit is then branched into the first compressed air substream conduit to the first distillation column system, and the second compressed air substream conduit to the second distillation column system. Alternatively, the two compressed air substream conduits are connected directly to the main heat exchanger.

If a plant according to the invention has, in addition to the main heat exchanger, a high-pressure exchanger, the latter is likewise utilized for both distillation column systems, meaning that the cold compressed air at high pressure from the high-pressure exchanger is distributed between the two distillation column systems and the product stream destined for the high-pressure exchanger is withdrawn in liquid form from the two distillation column systems, combined and sent to the high-pressure exchanger.

For manufacturing reasons, the main heat exchanger generally consists of a plurality of blocks connected in parallel in any case. In that case, it is advisable to divide the blocks into two symmetric groups in order to be able to better control the main heat exchanger. The air to be fractionated in the first distillation column system and the corresponding stream of impure nitrogen from the same distillation column system are conducted here through the first exchanger group. The corresponding streams for the and/or from the second distillation column system flow through the second group. The residual streams (product and turbine streams) are distributed homogeneously between the blocks of both groups.

U.S. Pat. No. 612,892 does disclose operating two double columns connected in parallel alongside one another in a common coldbox; however, the aim of this document is to configure the two double columns differently. The person skilled in the art would not consult this publication in the search for a way of maximizing the capacity of a plant. In any case, he does not receive any suggestion as to how a multistrand system could be altered in the manner of the object described above.

The apparatuses upstream and downstream of the two distillation column systems can especially be formed by a single precooling operation, a single air cleaning operation and/or a single heat exchanger.

It is favourable when, in the plant, the first distillation column system and the second distillation column system are of the same installation size and, more particularly, the high-pressure column, low-pressure column and argon column have equal dimensions. The "same installation size" is understood here to mean that the corresponding column heights and diameters differ from one another by not more than 10%, especially not more than 5%. The comparison relates, pair by pair, to the corresponding sections of the first and second high-pressure columns, the first and second low-pressure columns and the argon columns.

The two distillation column systems may each be accommodated in a separate coldbox. Alternatively, the first and second distillation column systems are arranged in a common coldbox.

In both cases, the two distillation column systems are operated independently of one another. The hot plant components and the main heat exchanger and optionally a high-pressure exchanger are utilized together, for example. For this purpose, one, more than one or all withdrawal conduit(s) for products from the two distillation column systems, if they are not intended for direct liquid product withdrawal, are combined pair by pair to a combined conduit which is connected to the cold end of the main heat exchanger, and then guided in a common conduit to the main heat exchanger or optionally to the high-pressure exchanger. Alternatively, each of the two distillation column systems has its own main heat exchanger and optionally its own high-pressure heat exchanger.

For independent operation, each of the two distillation column systems has a separate subcooling countercurrent heat exchanger which can be operated independently of the subcooling countercurrent heat exchanger of the other distillation column system and, more particularly, is not connected to pipelines from or to the other distillation column system.

More particularly, this means that the two distillation column systems are operable independently of one another.

The invention also relates to a method of obtaining oxygen by cryogenic fractionation of air. The method according to the invention can be supplemented by method features corresponding to the features of individual, several or all dependent apparatus claims.

The method of obtaining oxygen by cryogenic fractionation of air with a distillation column system comprises a high-pressure column and a low-pressure column, a main condenser configured as a condenser-evaporator, the liquefaction space of the main condenser being in flow connection with the top of the high-pressure column, and comprising an argon column which is in flow connection with an intermediate point in the low-pressure column, and has means of drawing off an argon-enriched stream and an argon column top condenser which is configured as a condenser-evaporator and is in flow connection with the top of the argon column, wherein feed air is introduced into the high-pressure column and an oxygen product stream is drawn off from the low-pressure column, the low-pressure column has an upper mass transfer region, a lower mass transfer region and a middle mass transfer region, the middle mass transfer region has at least one first mass transfer space which is open at the top toward the upper mass transfer region and at the bottom toward the lower mass transfer region, characterized in that the upper mass transfer region has a liquid collector at its bottom end, the first mass transfer space has a liquid distributor at its top, the argon column top condenser is arranged within the low-pressure column between the upper and middle mass transfer regions, the argon column top condenser is configured as a forced-flow evaporator, having an evaporation space which has an inlet at its bottom end and an outlet at its top end, and the outlet being connected to the liquid distributor of the first mass transfer space, an argon-enriched fraction is drawn off from the liquefaction space of the argon top condenser, liquid from the liquid collector arranged beneath the upper mass transfer region is introduced into the evaporation space of the argon column top condenser), and in that the argon column top condenser is controlled by withdrawing a biphasic mixture from the evaporation space of the argon condenser and introducing it into a vessel, drawing off a gas stream from the vessel via a control valve and drawing off a liquid stream from the vessel and introducing it into the liquid distributor at the top of the middle mass transfer section.

The advantages of the invention are manifested especially in particularly large plants having a multistrand configuration.

BRIEF DESCRIPTION OF THE DRAWINGS

The invention and further details of the invention are elucidated in detail hereinafter with reference to working examples shown in schematic form and the drawings. The drawings show.

DETAILED DESCRIPTION OF THE INVENTION

Figure 1:
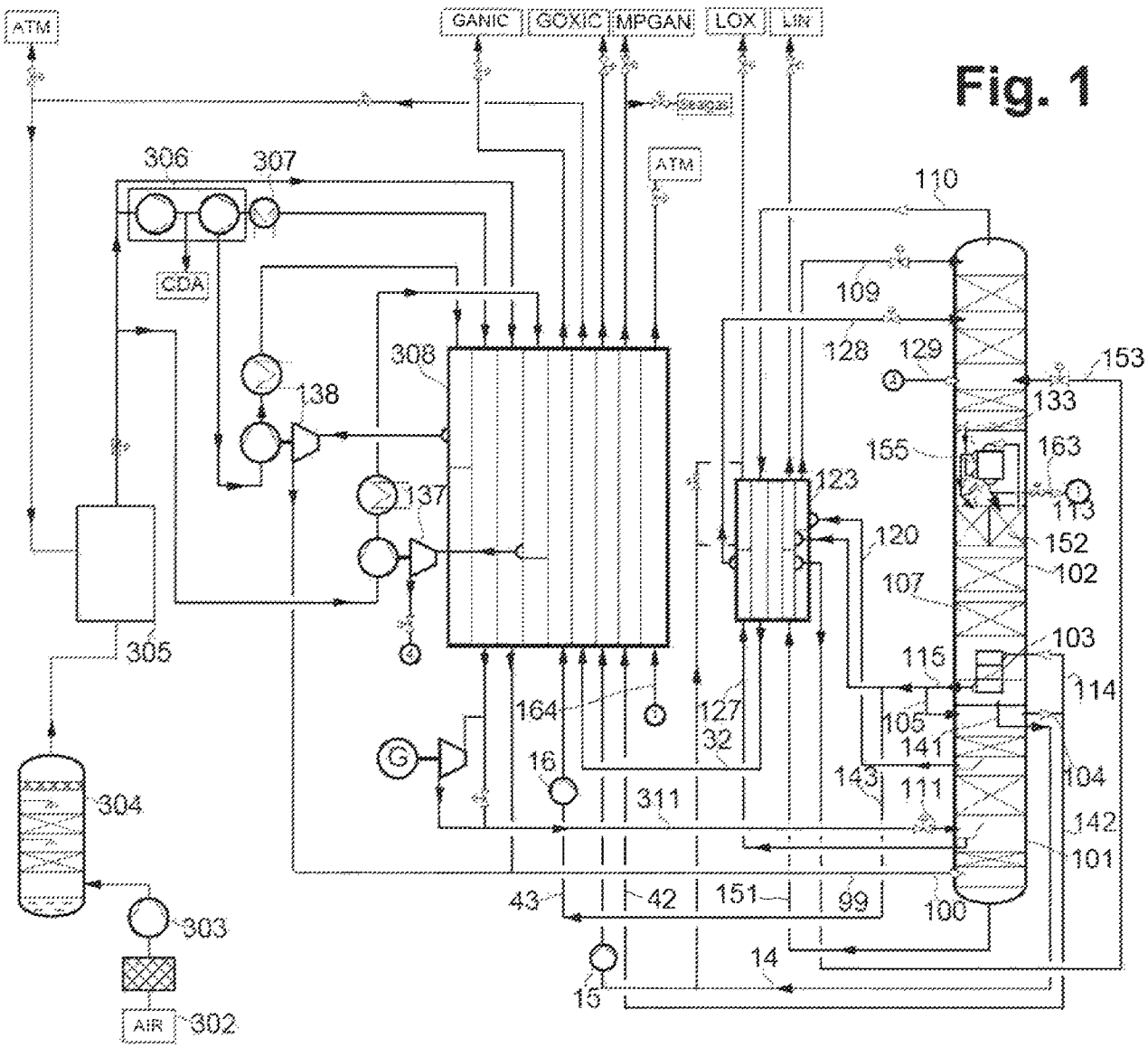
FIG. 1 is a first working example of a complete plant with a distillation column system according to the invention having a two-turbine system.

FIG. 1 shows a plant with a single distillation column system. The construction of the low-pressure column of this distillation column system is shown in detail in FIG. 6 (some of the reference signs mentioned below are shown only therein). The distillation column system of the working example of FIG. 1 has a high-pressure column 101, a low-pressure column 102, a main condenser 103 and an argon column 152.

The main condenser 103 is formed in the example by a three stage cascade evaporator, i.e. a multilevel pocket evaporator. The column pair 101/102 is arranged in the form of a double column. The argon column 152 is disposed in a middle mass transfer region 130 of the low-pressure column 102. The argon column top condenser 155 is inside the low-pressure column 102 above the middle mass transfer region 130. The low-pressure column 102 also has an upper mass transfer region 131 and a lower mass transfer region 132 (see FIG. 6 in particular).

The plant shown in FIG. 1 has an entry filter 302 for atmospheric air (AIR), a main air compressor 303, an air precooling unit 304, an air cleaning unit 305 (typically formed by a pair of molecular sieve adsorbers), a booster air compressor 306 (BAC) with downstream cooler 307 and a main heat exchanger 308. The main heat exchanger 308 is accommodated in a dedicated coldbox which is separate from the coldbox around the distillation column system. A combined compressed air stream 100 from the cold end of the main heat exchanger 308 is introduced into the high-pressure column 101.

The air boosted to its final pressure in the booster compressor 306 is liquefied in the main heat exchanger 308 (or—if its pressure is supercritical—pseudo-liquefied) and fed via conduits 311/111 to the distillation column system.

A nitrogen gas stream 104, 114 from the high-pressure column 101 is introduced into the liquefaction space of the main condenser 103. In the liquefaction space of the main condenser 103, liquid nitrogen 115 is produced therefrom and at least a first portion thereof is guided as the first liquid nitrogen stream 105 to the high-pressure column 101.

A liquid oxygen stream from the low-pressure column 102 flows away from the lower end of the lowermost mass transfer layer 107 of the low-pressure column 102 and hence is introduced into the evaporation space of the main condenser 103. Gaseous oxygen is formed in the evaporation space of the main condenser 103. At least a first portion thereof is introduced into the low-pressure column 102, in that it flows upward into the lowermost mass transfer layer 107 of the low-pressure column 102; a second portion can be obtained directly, if required, as gaseous oxygen product and warmed in the main heat exchanger 308 (not implemented in this working example).

The reflux liquid 109 for the low-pressure column 102 is formed by a nitrogen-enriched liquid 120 which is drawn off from the high-pressure column 101 from an intermediate point (or alternatively directly from the top) and cooled down in a subcooling countercurrent heat exchanger 123. Impure nitrogen 110 is drawn off from the top of the low-pressure column 102 and guided as residual gas through the subcooling countercurrent heat exchanger 123 and through the conduit 32 to the main heat exchanger 308.

An oxygen-enriched bottoms liquid stream 151 is drawn off from the high-pressure column 101 and cooled down in the subcooling countercurrent heat exchanger 123. In the example, the entire cooled bottoms liquid 153 is fed to the upper mass transfer region of the low-pressure column 102. It flows together with the reflux liquid coming from above into the lowermost section of the upper mass transfer region. The liquid running off from this section is collected by a liquid collector 133 and introduced into the evaporation space of the argon column top condenser 155. The argon column top condenser 155 here is configured in accordance with the invention as a forced-flow evaporator. The fraction evaporated in the top condenser 155 flows back into the upper mass transfer region 131 and the fraction 157 remaining in liquid form is fed into the middle mass transfer region 130 of the low-pressure column 102. The argon-enriched "product" 163 of the argon column is removed in gaseous form from the argon column 152 or the top condenser 155 thereof and guided through the main heat exchanger 308 via conduit 164 through a separate passage group.

Alternatively, it would be possible to mix the argon-enriched fraction 163 with the impure nitrogen and guide the mixture through the main heat exchanger.

The liquid air 111 from the main heat exchanger is fed via the conduit 111 to the high-pressure column 101 at an intermediate point. At least a portion 127 is withdrawn again immediately and introduced via the subcooler 123 and via the conduit 128 into the upper mass transfer region of the low-pressure column 102, and specifically above the feed of the bottoms fraction 153. Via conduit 129, gaseous air from an air injection turbine 137 is additionally introduced into the low-pressure column 102, at the same level as the crude oxygen 153.

The main product drawn off from the distillation column systems is liquid oxygen 141 from the evaporation space of the main condenser 103, and it is fed via conduit 14 at least partly to an internal compression. This involves pumping the liquid oxygen 14 by means of a pump 15 to a high product pressure, evaporating it or (if its pressure is supercritical) pseudo-evaporating it in the main heat exchanger 308 under this high product pressure, warming it to about ambient temperature and finally drawing off GOXIC as the gaseous compressed oxygen product. This is the main product of the plant of the working example.

A further product from the plant is compressed nitrogen, which is drawn off directly from the top of the high-pressure column 101 (conduits 104, 142), conducted via conduit 42 to the main heat exchanger 308, warmed therein and finally obtained as gaseous compressed nitrogen product MPGAN. A portion thereof can be used as seal gas. In addition, a portion 143 of the liquid nitrogen produced in the main condenser 103 can be fed via conduit 43 to an internal compression (pump 16) and obtained as gaseous high-pressure nitrogen product GANIC. The plant can also supply liquid products LOX, LIN.

In a specific example, the mass transfer elements in the low-pressure column 102 are formed exclusively by structured packing. The oxygen section 107 of the low-pressure column 102 is equipped with a structured packing having a specific surface area of 750 $m^2/m^3$ or alternatively 1200 $m^2/m^3$; in the other sections, the packing has a specific surface area of 750 or 500 $m^2/m^3$. In addition, the low-pressure column 102 may have a nitrogen section above the mass transfer regions shown in the drawing; this may likewise be equipped with a particularly dense packing (for example having a specific surface area of 1200 $m^2/m^3$ for the purpose of reducing the column height). In a departure from this, it is possible to combine structured packing of different specific surface area within any of the sections mentioned. The argon column 152, in the working example, contains exclusively packing having a specific surface area of 1200 $m^2/m^3$ or alternatively 750 $m^2/m^3$.

In the high-pressure column 101, the mass transfer elements are formed exclusively by structured packing having a specific surface area of 1200 $m^2/m^3$ or 750 $m^2/m^3$. Alternatively, at least a portion of the mass transfer elements in the high-pressure column 101 could be formed by conventional distillation trays, for example by sieve trays.

The system of FIG. 1 is configured as a two-turbine method with a medium-pressure turbine 138 and an air injection turbine 137.

Figure 2:
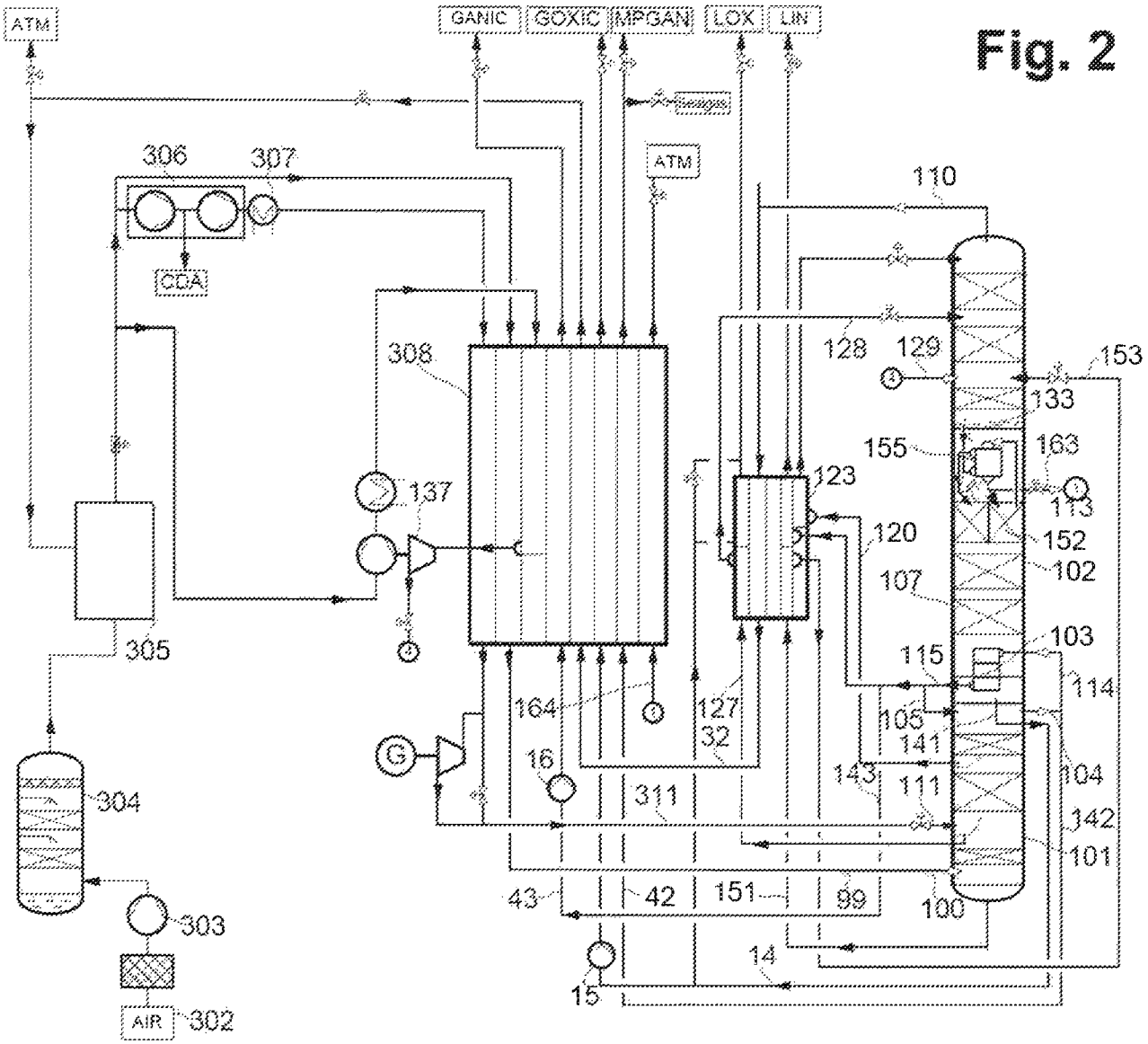
FIG. 2 is a second working example with only one refrigerating turbine, an air injection turbine.

The working example of FIG. 2 differs from FIG. 1 in that it is configured as a one-turbine system. It has only one air injection turbine, and no medium-pressure turbine.

Figure 3:
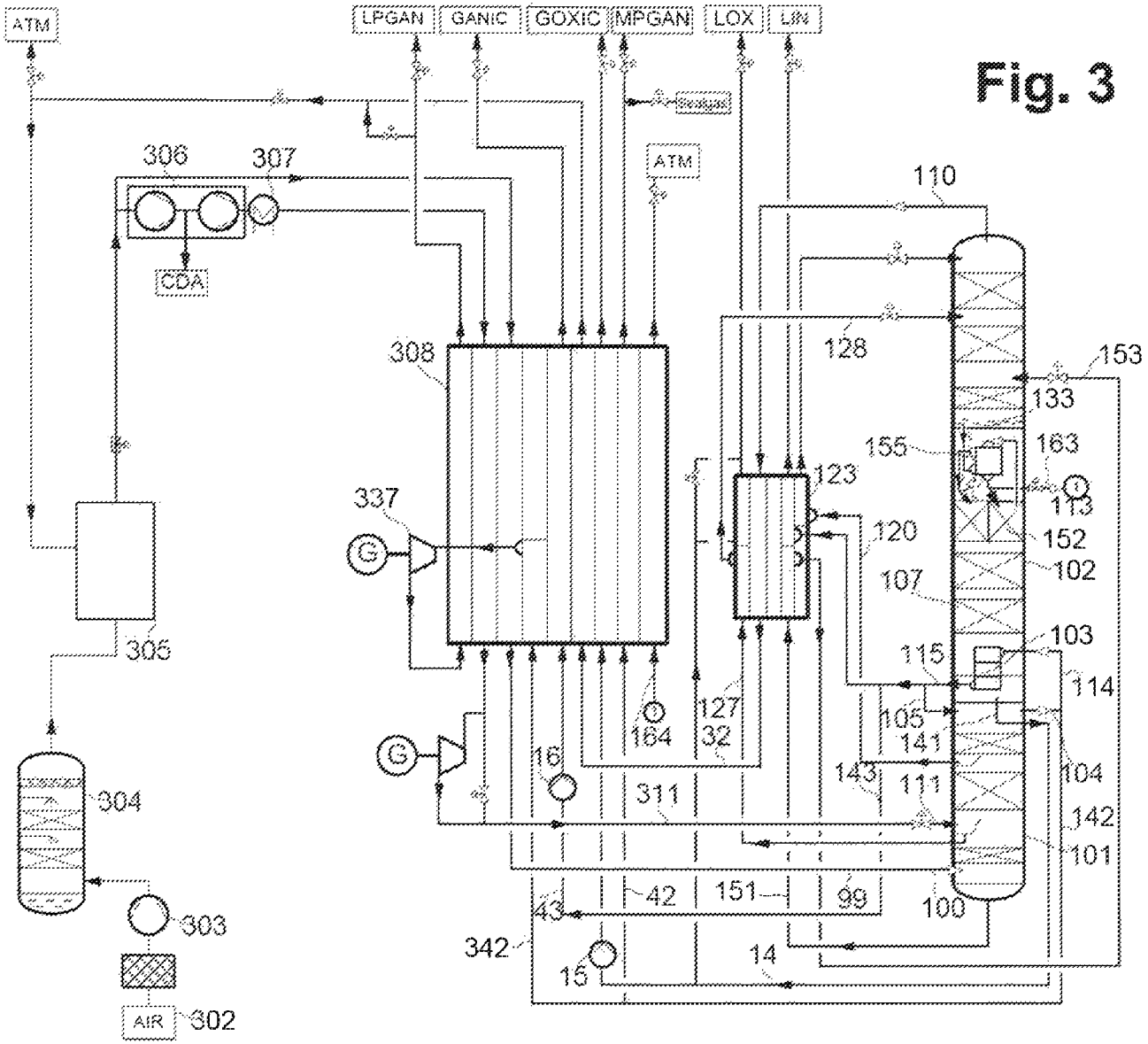
FIG. 3 is a third working example with a pressurized nitrogen turbine.

FIG. 3 is almost identical to FIG. 2, but instead of the air injection turbine has a compressed nitrogen turbine 337. It is operated with a portion 342 of the compressed nitrogen 142 which is drawn off in gaseous form from the top of the high-pressure column 101.

Figure 4:
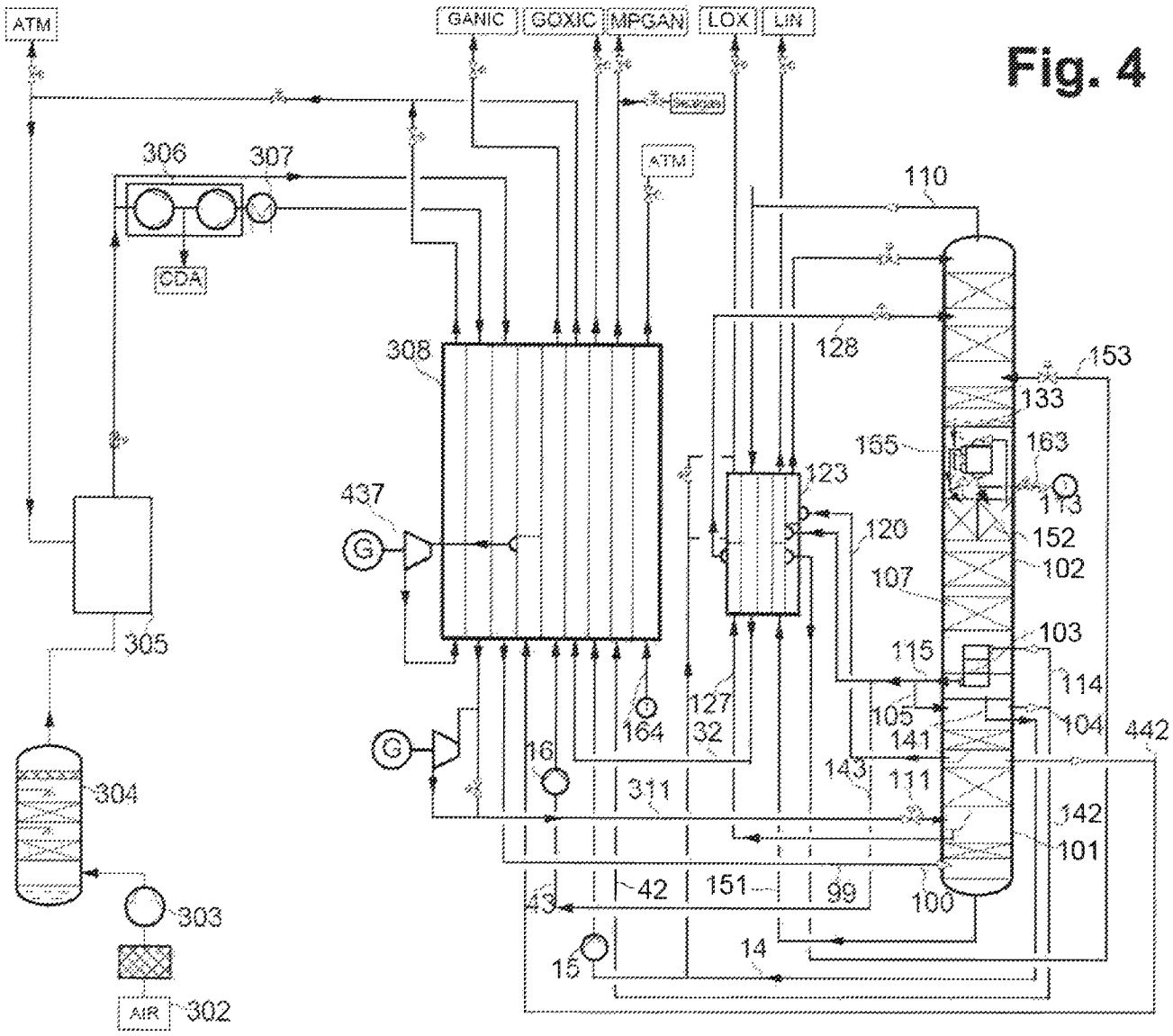
FIG. 4 is a fourth double column system with an impure nitrogen turbine.

In FIG. 4, the turbine stream 442 is instead drawn off from an intermediate point in the high-pressure column 101 and expanded to perform work in an impure nitrogen turbine 437.

Figure 5:
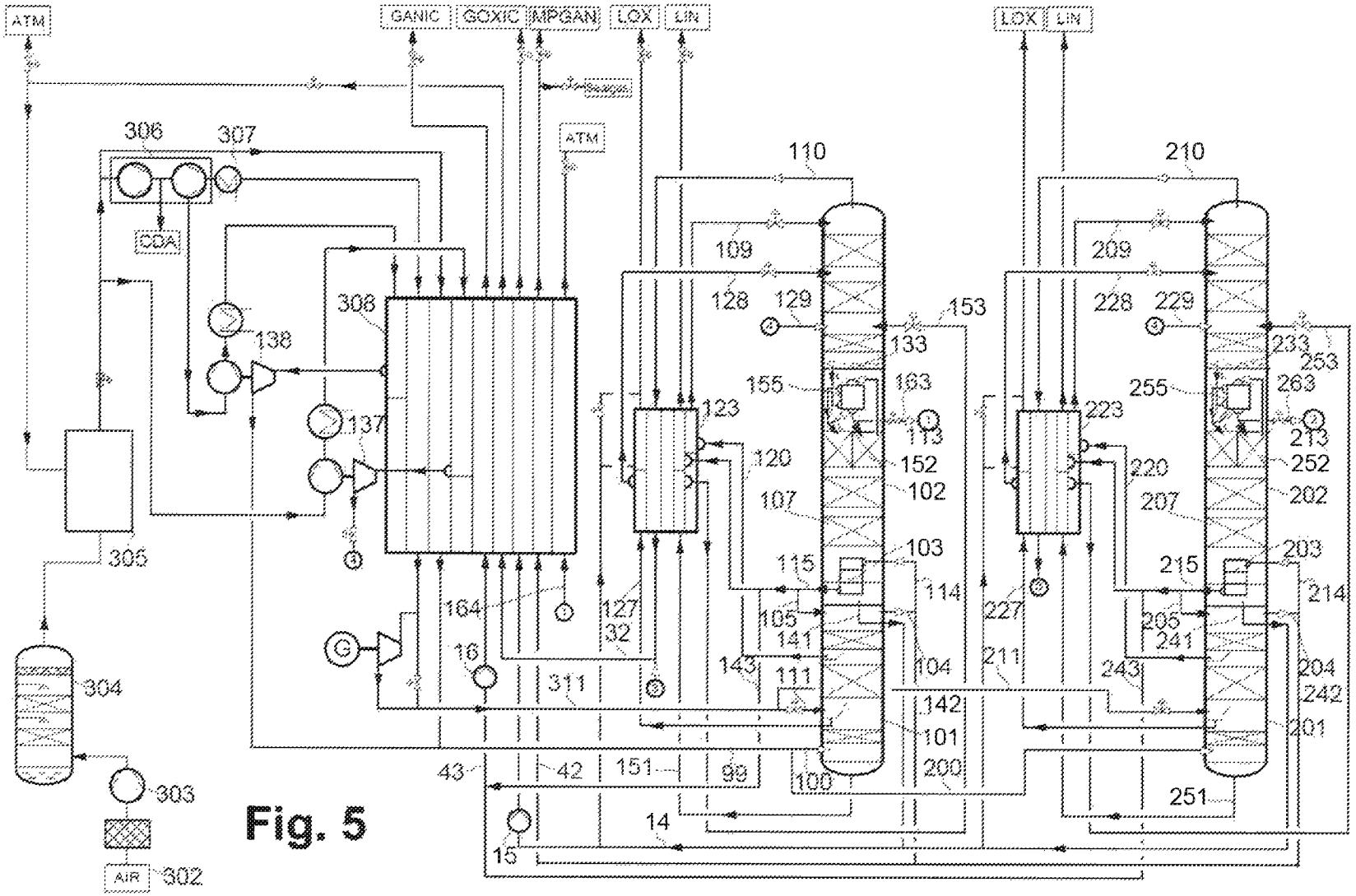
FIG. 5 is a fifth working example with two distillation column systems according to the invention ("twin column").

FIG. 5 shows a plant having two distillation column systems which is configured in accordance with the invention.

The first distillation column system of the working example of FIG. 5 has a first high-pressure column 101, a first low-pressure column 102, a first main condenser 103 and a first argon column 152. A second high-pressure column 201, a second low-pressure column 202, a second main condenser 203 and a second argon column 252 form part of the second distillation column system in the plant shown in FIG. 1.

Each of the main condensers 103, 203 is formed in the example by a three-stage cascade evaporator. The column pairs 101/102, 201/202 are arranged in the form of two double columns. The argon columns 152/252 are arranged in a middle mass transfer region of the low-pressure columns 102, 202. The argon top column condensers 155, 255 are inside the respective low-pressure columns 102, 202 above the middle mass transfer region 113, 213 and are configured in accordance with the invention as forced-flow evaporators. The low-pressure columns is 102, 202 also each have an upper mass transfer region above their argon column top condenser 155, 255 and a lower mass transfer region below their argon column 152/252 or the middle mass transfer region 113, 213. The arrangement of the mass transfer regions in the low-pressure columns is apparent from FIG. 6 in particular.

Each of the two distillation column systems is controlled independently. The pressure in the low-pressure columns can, for example, be set and controlled separately. This decoupling also lessens the overall closed-loop control complexity and allows any manufacturing tolerances in the two double columns to be better compensated for.

The plant shown in FIG. 5 has an entry filter 302 for atmospheric air (AIR), a main air compressor 303, an air precooling unit 304, an air cleaning unit 305 (typically formed by a pair of molecular sieve adsorbers), a booster air compressor 306 (BAC) with downstream cooler 307 and a main heat exchanger 308. The main heat exchanger 308 is accommodated in a dedicated coldbox which is separate from the coldbox(es) around the distillation column systems.

A combined compressed air stream 99 from the cold end of the main heat exchanger 308 is branched into a first compressed air substream 100 and a second compressed air substream 200. The first compressed air substream 100 is introduced into the first high-pressure column 101, and the second compressed air substream 200 into the second high-pressure column 201.

The air boosted to its final pressure in the booster compressor 306 is liquefied (or—if its pressure is supercritical—pseudo-liquefied) in the main heat exchanger 308 and fed via conduit 311 to the distillation column systems and branched therein into the streams 111 and 112.

A first nitrogen gas stream 104, 114 from the first high-pressure column 101 is introduced into the liquefaction space of the first main condenser 103. Liquid nitrogen 115 is produced in the liquefaction space of the first main condenser 103, and at least a first portion thereof is guided as a first liquid nitrogen stream 105 to the first high-pressure column 101.

A second nitrogen gas stream 204, 214 from the second high-pressure column 201 is introduced into the liquefaction space of the second main condenser 203. Liquid nitrogen 215 is produced in the liquefaction space of the second main condenser 203, and at least one first portion thereof is guided as a second liquid nitrogen stream 205 to the second high-pressure column 201.

A first liquid oxygen stream from the first low-pressure column 102 flows away from the lower end of the lowermost mass transfer layer 107 of the first low-pressure column 102 and hence is introduced into the evaporation space of the first main condenser 103. Gaseous oxygen is formed in the evaporation space of the first main condenser 103. At least a first portion thereof is introduced as first oxygen gas stream into the first low-pressure column 102, in that it flows from below into the lowermost mass transfer layer 107 of the first low-pressure column 102; a second portion can, if required, be obtained directly as gaseous oxygen product and warmed in the main heat exchanger 308.

A second liquid oxygen stream from the second low-pressure column 202 flows away from the lower end of the lowermost mass transfer layer 207 of the second low-pressure column 202 and hence is introduced into the evaporation space of the second main condenser 203. Gaseous oxygen is formed in the evaporation space of the second main condenser 203. At least a first portion thereof is introduced as second oxygen gas stream into the second low-pressure column 202, in that it flows from the bottom into the lowermost mass transfer layer 207 of the second low-pressure column 202; a second portion can, if required, be obtained directly as gaseous oxygen product and warmed in the main heat exchanger 308 (not shown).

The reflux liquids 109, 209 for the two low-pressure columns 102, 202 are each formed by an nitrogen-enriched liquid 120, 220 which is drawn off in both high-pressure columns 101, 201 from an intermediate point (or alternatively directly from the top) and cooled down in subcooling countercurrent heat exchangers 123, 223. Impure nitrogen 110, 210 is drawn off from the top of both low-pressure columns 102, 202 and guided as residual gas through one subcooling countercurrent heat exchanger 123, 223 in each case and via the common conduit 32 to the main heat exchanger 308.

One oxygen-enriched bottoms liquid stream 151, 251 is drawn off from each of the two high-pressure columns 101, 201 and cooled down in the respective subcooling countercurrent heat exchanger 123, 223. In the example, the entire cooled bottoms liquid 153, 253 is fed to the upper mass transfer region of the low-pressure columns 102, 202. It flows together with the reflux liquid coming from above into the lowermost section of the upper mass transfer region. The liquid running downward from this section is collected by a liquid collector 133, 233 and introduced into the evaporation space of the argon column top condenser 155, 255. The argon column top condenser 155, 255 here is configured in accordance with the invention as a forced-flow evaporator. The fraction which has evaporated in the top condenser 155, 255 flows back into the upper mass transfer region, and the fraction remaining in liquid form 157, 257 is fed into the middle mass transfer region 130 of the low-pressure column 102, 202. The argon-enriched "product" 163, 263 of the argon columns is withdrawn in gaseous form from the argon column 152, 252 or the top condenser thereof 155, 255 and guided through the main heat exchanger 308 via conduit 164 through a separate passage group.

Alternatively, it would be possible to mix the argon-enriched fractions 163, 263 with the impure nitrogen 110, 210 and conduct the mixture through the main heat exchanger.

The liquid or supercritical air 311 from the main heat exchanger is fed via conduits 111, 211 to the high-pressure columns 101, 201 at an intermediate point. At least a portion 127, 227 is withdrawn again immediately and introduced through the subcoolers 123, 323 and via the conduit 128, 228 into the upper mass transfer region of the low-pressure columns 102, 202, above the feed of the bottoms fraction 153, 253. Gaseous air from an air injection turbine 137 is also introduced via conduit 129, 229 into the low-pressure columns 102, 202, at the same level as the crude oxygen 153, 253.

The main product drawn off from the distillation column systems is liquid oxygen 141, 241 from the evaporation space of the main condensers 103, 203, and it is combined and fed via conduit 14 at least partly to an internal compression. This involves pumping the liquid oxygen 14 by means of a pump 15 to a high product pressure, evaporating it or (if its pressure is supercritical) pseudo-evaporating it in the main heat exchanger 308 under this high product pressure, warming to about ambient temperature and finally drawing off GOXIC as the gaseous compressed oxygen product. This is the main product of the plant of this working example.

A further product from the plant is compressed nitrogen, which is drawn off directly from the top of the high-pressure columns 101, 201 (conduits 104, 142 and 204, 242), conducted together via conduit 42 to the main heat exchanger 308, warmed therein and finally obtained as gaseous compressed nitrogen product MPGAN. A portion thereof can be used as seal gas. In addition, a portion 143, 243 of the liquid nitrogen produced in the main condensers 103, 203 can be fed via conduit 43 to an internal compression (pump 16) and obtained as gaseous high-pressure nitrogen product GANIC.

The plant can also supply liquid products LOX, LIN. These can be removed separately as shown from each distillation column system.

In a specific example, the mass transfer elements in the two low-pressure columns 102, 202 are formed exclusively by structured packing. The oxygen sections 107, 207 of the two low-pressure columns 102, 202 are equipped with a structured packing having a specific surface area of 750 $m^2/m^3$ or alternatively 1200 $m^2/m^3$; in the other sections, the packing has a specific surface area of 750 or 500 $m^2/m^3$. In addition, the two low-pressure columns 102, 202 may have a nitrogen section above the mass transfer regions shown in the drawing; this may likewise be equipped with a particularly dense packing (for example having a specific surface area of 1200 $m^2/m^3$ for the purpose of reducing the column height). In a departure from this, it is possible to combine structured packing of different specific surface area within any of the sections mentioned. The argon columns 152, 252, in the working example, contain exclusively packing having a specific surface area of 1200 $m^2/m^3$ or alternatively 750 $m^2/m^3$.

In the high-pressure columns 101, 201, the mass transfer elements are formed exclusively by structured packing having a specific surface area of 1200 $m^2/m^3$ or 750 $m^2/m^3$. Alternatively, at least a portion of the mass transfer elements in the two high-pressure columns 101, 201 could be formed by conventional distillation trays, for example by sieve trays.

The system of FIG. 5 is configured analogously to FIG. 1 as a two-turbine method with a medium-pressure turbine 138 and an air injection turbine 137. Alternatively, in the system of FIG. 5 having two distillation column systems, it would also be possible to use the turbine configurations of FIG. 2, 3 or 4.

Each of the two distillation column systems is controlled independently. The pressure in the low-pressure columns can, for example, be set and controlled separately. This decoupling also lessens the overall closed-loop control complexity and allows any manufacturing tolerances in the two double columns to be better compensated for.

Figure 6:
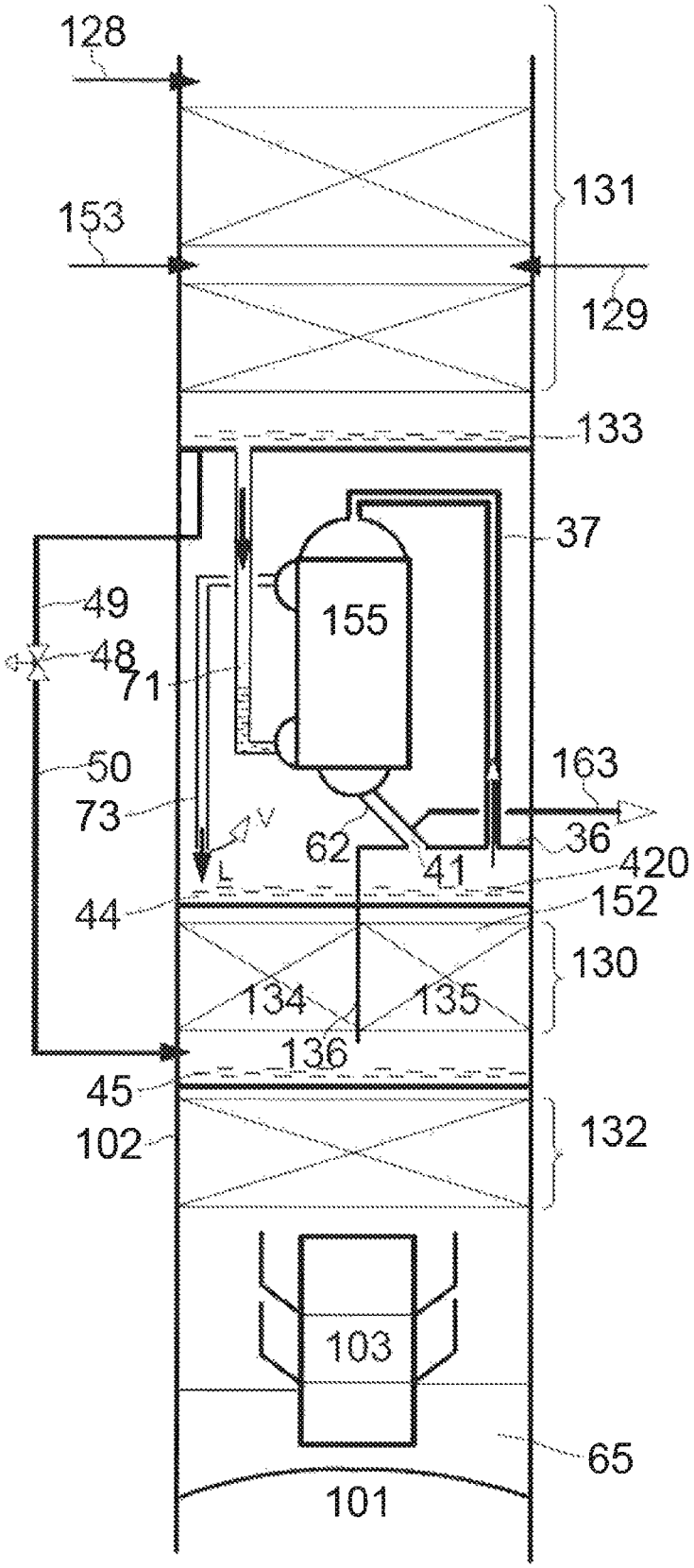
FIG. 6 is a detail view of the low-pressure column with a first closed-loop control concept for the argon column condenser with liquid bypass.

With reference to the detailed drawing of FIG. 6, the exact function of argon column and argon column top condenser and the closed-loop control thereof will now be elucidated. This detail can be applied to any of the preceding working examples.

FIG. 6 shows just a section of the double column 101, 102, which extends from the upper end of the high-pressure column 101 to the second packing layer of the upper mass transfer region 131 of the low-pressure column, and more particularly contains the argon column 152 and the argon column top condenser 155. It will be appreciated that the working example of FIG. 6 can also be used in other two-column systems, for example those having an arrangement of the low-pressure column alongside the high-pressure column and/or with arrangement of the main condenser outside the low-pressure column.

In the main condenser 103, liquid oxygen is evaporated, which runs down from the lower mass transfer region 132 or is sucked in from the bath in the bottom of the low-pressure column; in contrast to this, gaseous nitrogen from the top of the high-pressure column 101 is evaporated. (The nitrogen conduits are not shown in FIG. 6.)

The liquid collectors and distributors are not shown in FIG. 6 apart from the collector 133 between the upper mass transfer region 131 and the argon column top condenser 155, the two liquid distributors 44, 420 at the top of the first and second mass transfer space 134, 135 and the liquid distributor 45 at the top of the lower mass transfer section 132. For the rest as well, FIG. 6 is very schematic and should generally not be regarded as being to scale.

The middle mass transfer region 130 of the low-pressure column is subdivided by a vertical flat dividing wall 136 in a gas-tight manner into first mass transfer space 134 and a second mass transfer space 135. The first mass transfer space 134 is open in the upward direction toward the upper mass transfer region 131 and in the downward direction toward the lower mass transfer region 132, meaning that gas from the lower mass transfer region 132 can flow into the first mass transfer space 134 of the middle mass transfer region 131, and gas from the first mass transfer space 134 can flow away upward into the upper mass transfer region of the low-pressure column. The first mass transfer space 134 fulfils the function of the argon section of the low-pressure column, i.e. of that mass transfer region which, in a conventional plant, is immediately above the argon transition, through which an argon-containing fraction would be passed to an external crude argon column or argon column.

The second mass transfer space 135, which forms the argon column 152, is likewise open in the downward direction toward the lower mass transfer region 132; ascending gas flows out of the lower mass transfer region 132 of the low-pressure column into the second mass transfer space 135 in this way. At its upper end, the second mass transfer space 135, however, is sealed in a gas-tight manner from the upper mass transfer region 131. The seal in the upward direction is brought about by a horizontal plate 36 which—apart from the conduits 37, 62, 41 conducted through it—is gas tight. Between the upper 131 and middle 130 mass transfer regions is the argon column top condenser 155, which is configured as a condenser-evaporator, here in accordance with the invention as a forced-flow evaporator. In this working example, it consists of a single plate heat exchanger block. Alternatively, it could also be formed by two or more plate heat exchanger blocks arranged in parallel. The liquefaction space of the argon column top condenser 155 is in flow connection with the top of the argon column 152 via the gas conduit 37 and the liquid conduits 62, 41. In this case, top tops gas from the argon column 152 flows via the gas conduit 37 from the upper end of the second mass transfer space 135 into the liquefaction space and is at least partly liquefied there. The liquid produced is drawn off via conduit 62, recycled via conduit 41 into the second mass transfer space 135 and distributed by means of a liquid distributor 420 as reflux liquid to the argon column over the cross section of the second mass transfer space 135. The proportion 163 remaining in gaseous form is drawn off from the vessel of the low-pressure column 102 and treated further as shown in FIGS. 1 to 5.

The liquid flowing away from the two mass transfer spaces 134, 135 of the middle mass transfer region 130 is collected in a liquid collector (not shown). The liquid flows onward to the liquid distributor 45, which distributes it over the entire column cross section and applies it to the lower mass transfer region 132.

The crude oxygen 153 from the bottom of the high-pressure column 101 is—similarly to FIG. 1—introduced between two packing sections of the upper mass transfer region 131. At the same point, an air stream 129 is introduced, which has previously been expanded to about low-pressure column pressure so as to perform work (see air injection turbines 137 in FIGS. 1, 2 and 5).

In addition, liquid air 128 is introduced into the upper mass transfer region 131. Virtually all the liquid from the upper mass transfer region 131 is collected in the liquid collector 133 and introduced via the conduit 71 into the evaporation space of the argon column top condenser 155. This has two advantages:

- The amount of liquid which flows via conduit 71 through the evaporation space is particularly large. In the argon column top condenser, preferably 35% to 55%, for example about 45%, of this amount of liquid is evaporated.
- This liquid has a relatively high oxygen content and hence a comparatively high evaporation temperature. This allows a particularly small temperature differential to be achieved; in three specific examples, it is 0.8 K, 1.0 K or 1.5 K. This allows the thermodynamic losses in the condenser to be kept particularly small.

The high liquid excess is thus of considerable significance for the efficiency of the forced-flow evaporator.

A biphasic mixture emerges via conduit 73 from the evaporation space of the condenser 155. The liquid component L flows into the liquid distributor 44 at the top of the first mass transfer space 134. The evaporated component V flows back upward into the upper mass transfer section 131.

The closed-loop control of the argon column top condenser 155 is effected in the working example of FIG. 6 by a closed-loop control method 1 which requires a bypass conduit 49/50 and a closed-loop control valve 48. In this way, the performance of the argon column top condenser 155 is controlled.

A small amount of relatively nitrogen-rich liquid flows into the distributor 45 and increases the nitrogen content in the vapour ascending out of the lower section 132 and hence also in the overall argon column 152 and additionally in the liquefaction space of the argon column top condenser 155. Thus, this control conduit and the valve arranged therein enable a controlled reduction in the performance of the condenser. The relatively nitrogen-rich liquid, in the working example, comes from the collector 133 at the lower end of the upper mass transfer region 131.

The closed-loop control valve 48 is closed in steady-state operation, or only a very small amount of liquid flows through it. In the event of deviations from steady-state operation, for example in the event of a change in load, generally less than 5% of the overall liquid 71/49 from the liquid chamber 133 flows through the bypass conduit, and in any case less than 15%.

Alternatively, other closed-loop control methods can be employed, one of which is described in detail hereinafter.

Figure 7:
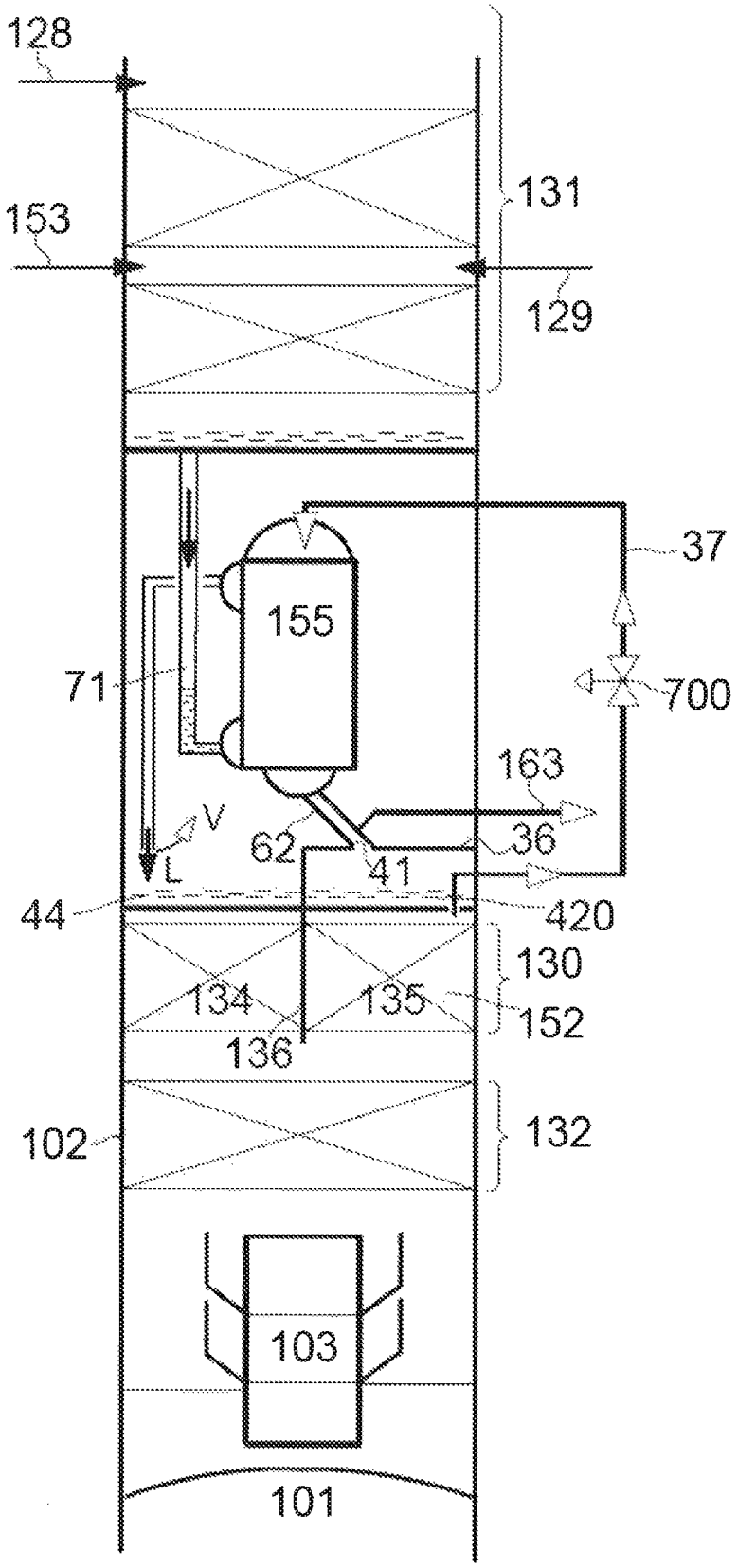
FIG. 7 is a further closed-loop control concept with a closed-loop control valve for the conversion in the argon column.

FIG. 7 shows an alternative closed-loop control method 2 with a closed-loop control valve 700 in the gas inlet 37 to the liquefaction space of the argon column top condenser 155. This valve can be used to adjust the condensation pressure with appropriate condensation temperature. This directly influences the driving temperature differential in the condenser 155 and correspondingly also the condenser performance or the conversion in the argon column 152. The valve can be controlled via the pressure differential in the argon column (PDIC=pressure difference indication and control, not shown).

Figure 8:
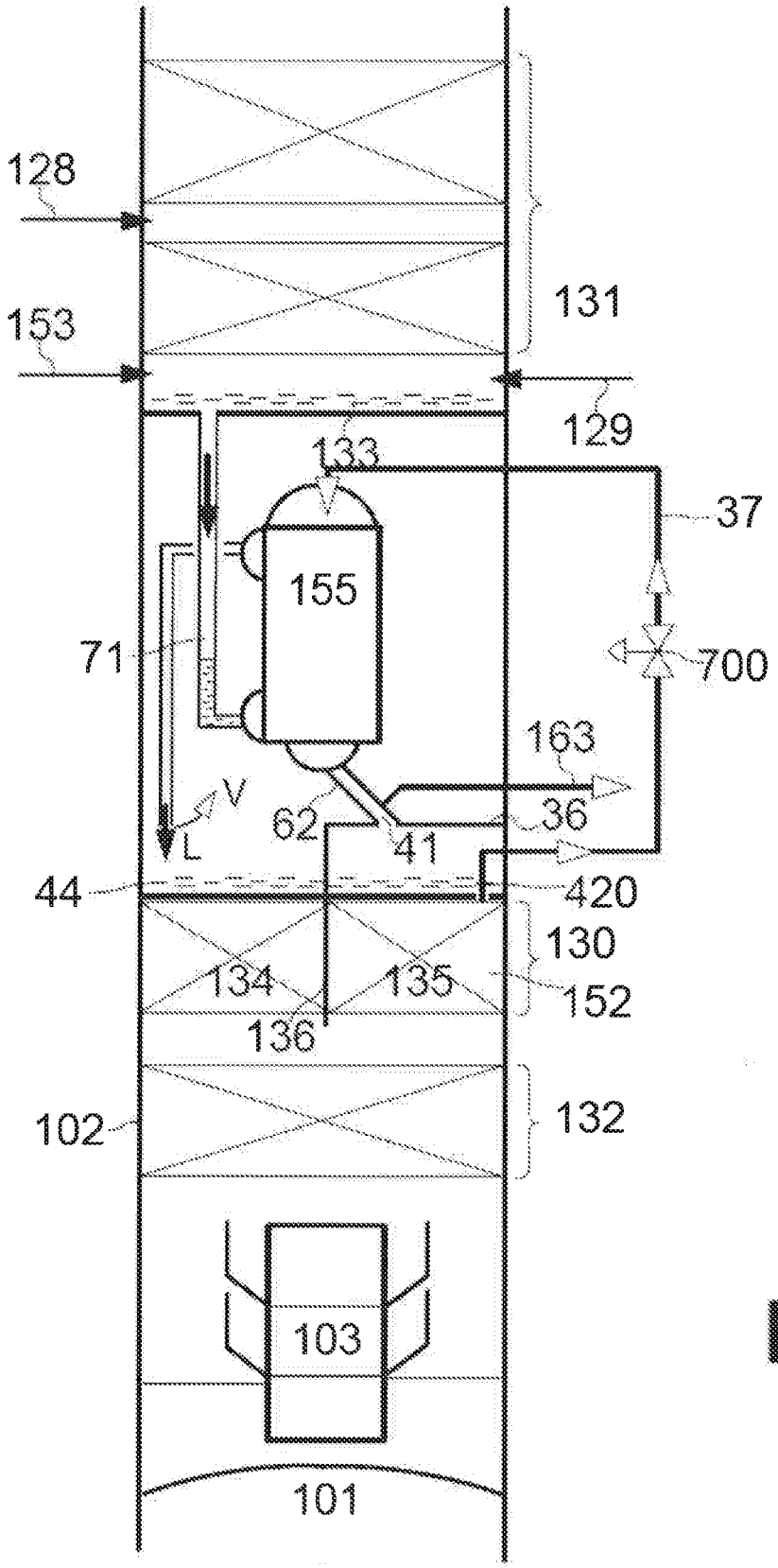
FIG. 8 is a modification of FIG. 7 without a separate packing section for the crude oxygen from the high-pressure column.

The only difference in FIG. 8 with respect to FIG. 7 is the lack of a mass transfer region between the introduction of the liquid crude oxygen 153 from the bottom of the high-pressure column and the liquid collector 133 at the lower end of the upper mass transfer region 131. In other words, the liquid crude oxygen is introduced directly into the liquid collector 133 and hence into the evaporation space of the condenser 155.

Figure 12:
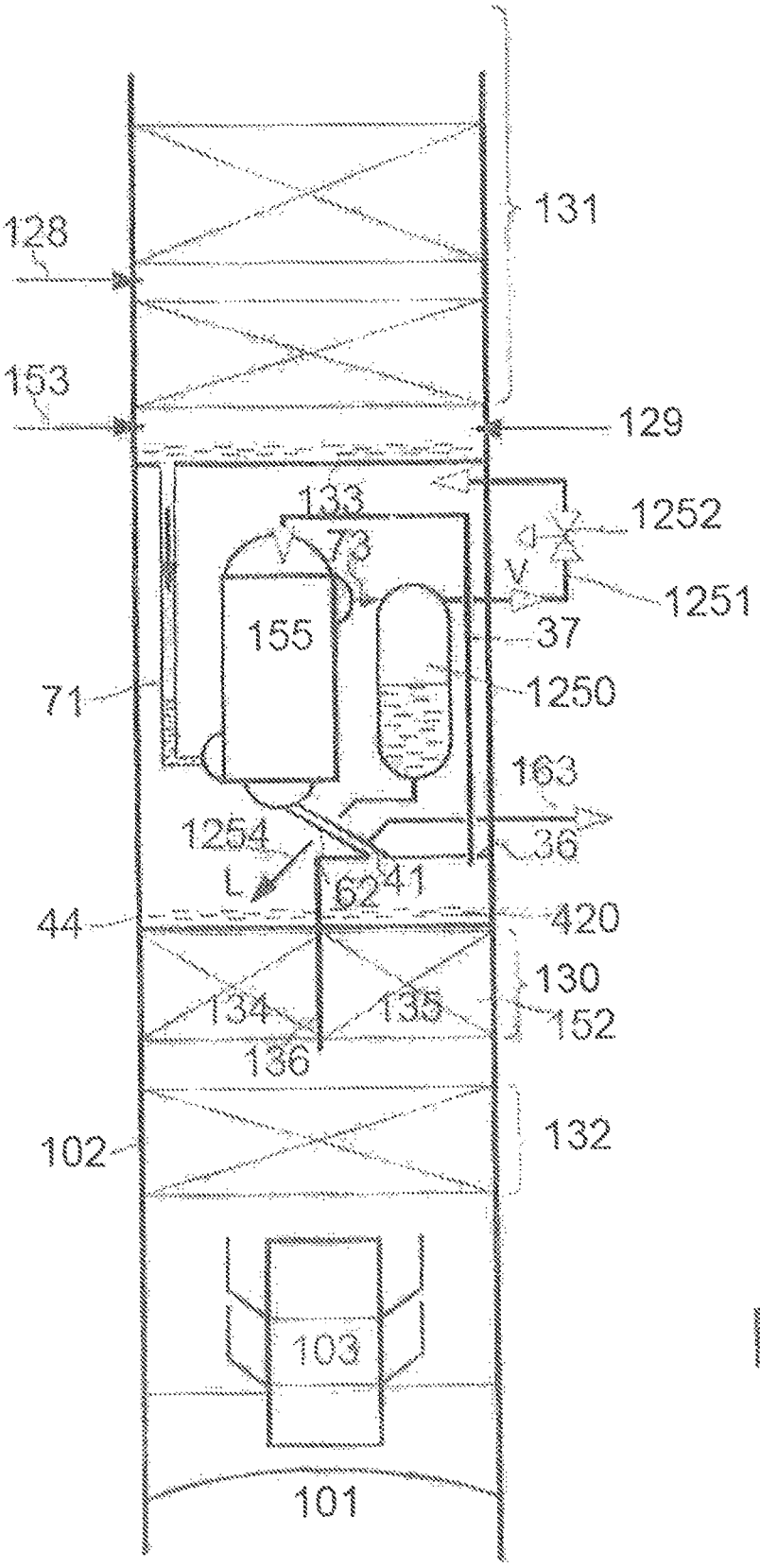
FIG. 12 is a third closed-loop control concept derived from FIGS. 6 and 7.

A closed-loop control method 3 is shown in FIG. 12. Here, the biphasic mixture from the evaporation space of the argon condenser 155 is introduced into an additional vessel 1250. Via conduit 1251, the gaseous component V is returned to the low-pressure column, such that it is available as ascending vapour in the upper mass transfer section 131. The liquid component L is introduced via conduit 1254 into the liquid distributor 44 at the top of the first mass transfer space 134 (of the argon section). By means of a closed-loop control valve 1252, the pressure in the evaporation space of the argon condenser 155 and hence the performance thereof can be adjusted.

The liquid conduit 1254 may likewise have a closed-loop control valve. Alternatively, the liquid flow is controlled by a fixed diaphragm, for example in the form of an opening in the base of the vessel 1250. The dimensions of this have to be such that the liquid level in the vessel, according to the pressure in the vessel, will vary between the upper and lower vessel limits.

Figure 9:
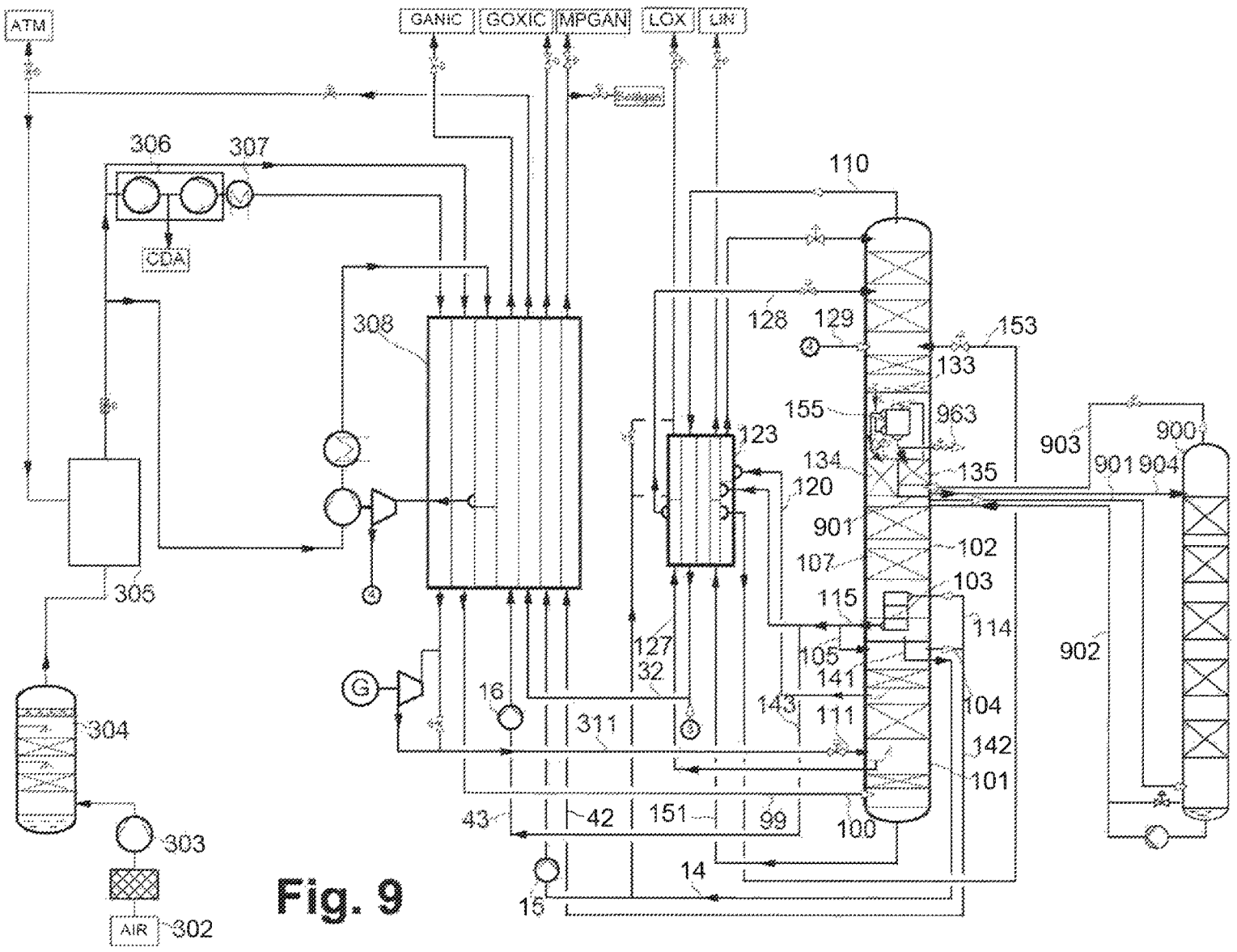
FIGS. 9 to 11 are three embodiments with complete argon recovery.

FIG. 9 is based on FIG. 2, but has a complete recovery of argon, in which the oxygen content in the top product 963 from the argon column is reduced, for example, to 0.1 to 100 ppm. The substantially oxygen-free argon gas 963 is subsequently fed to a pure argon column in which an argon-nitrogen separation is undertaken. For the low oxygen content necessary for this purpose, the few theoretical plates in the dividing wall section 135 are insufficient. Therefore, a crude argon column 900 of almost standard length is used, utilizing the second mass transfer space 135 in the dividing wall section of the low-pressure column 102 as the uppermost mass transfer region of the crude argon rectification. For this purpose, the second mass transfer space 135 has to be sealed gas-tight at its lower end, for example by a semicircular plate. Below this plate, argon-containing gas 901 is drawn off from the low-pressure column 102 and fed to the bottom of the crude argon column 900. The bottoms liquid 902 from the crude argon column 900 is conducted in the opposite direction at the same point in the low-pressure column 102. The top of the crude argon column is in flow connection via conduits 903 (for gas) and 904 (for liquid) with the lower end of the second mass transfer space 135. As known from FIGS. 1 to 7, the upper end thereof is connected to argon column top condenser 155.

Figure 10:
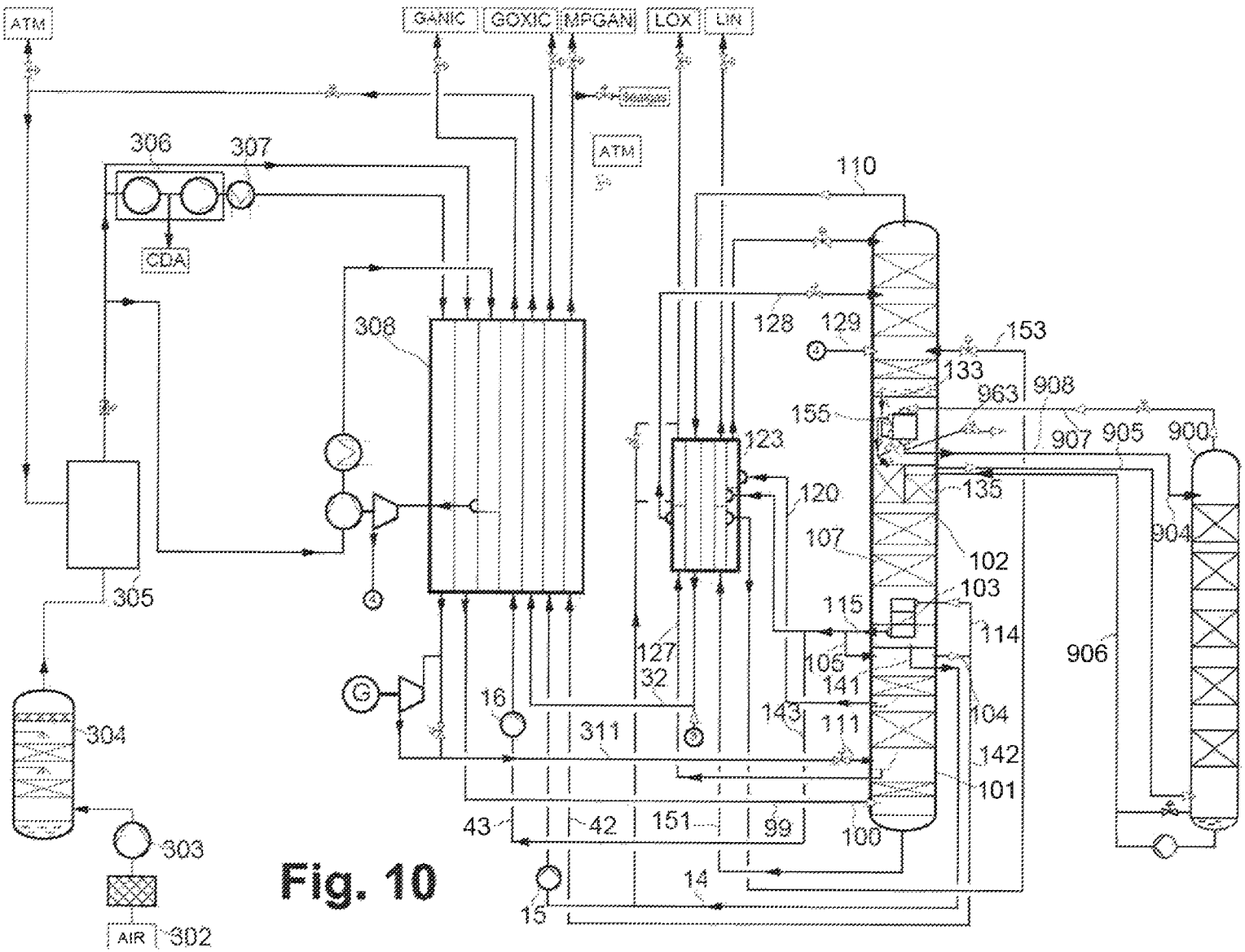

In the working example of FIG. 10, the second mass transfer space 135 is open at the bottom end and in this respect is operated analogously to FIGS. 1 to 5. However, the top thereof is not connected directly to the argon top condenser 155, but connected via conduits 905 and 906 to the bottom of the crude argon column 900. The top of the crude argon column is in flow connection via conduits 907 and 908 with the liquefaction space of the argon column top condenser.

Figure 11:
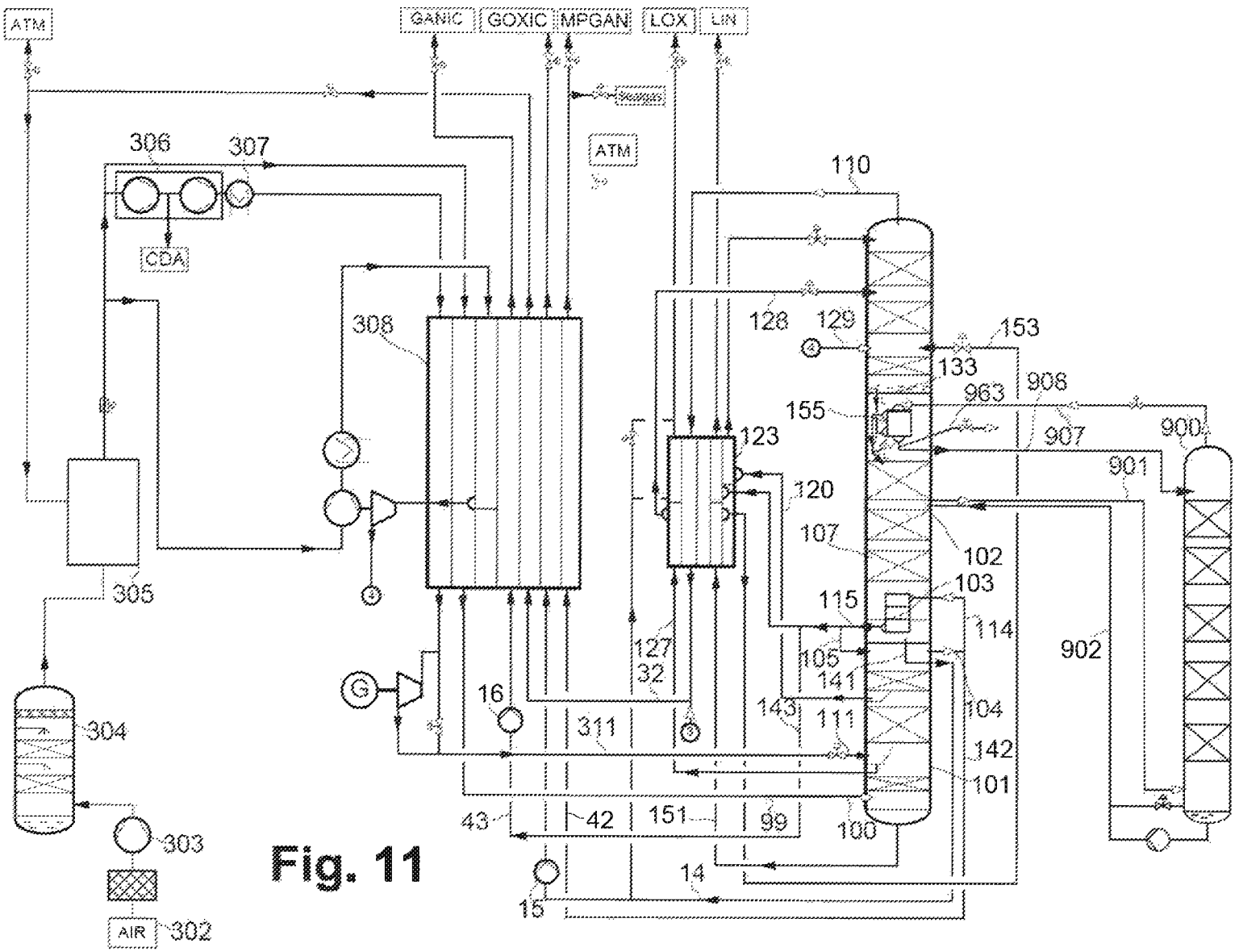

FIG. 11 shows a working example without a dividing wall section in the low-pressure column. The argon column here consists exclusively of the separate crude argon column 900, the top of which, analogously to FIG. 10, is connected (907, 908) to the argon column top condenser 155. The bottom of the crude argon column 900 of FIG. 11, analogously to FIG. 9, is connected (901, 902) to an appropriate intermediate point in the low-pressure column 102.

What I claim is:

1. A distillation column system for obtaining oxygen by cryogenic fractionation of air, comprising a high-pressure column and a low-pressure column, a main condenser, which is a condenser-evaporator, having a liquefaction space in flow connection with a top of the high-pressure column, an argon column which is in flow connection with an intermediate point in the low-pressure column, said argon column having a line for withdrawing an argon-enriched stream, and an argon column top condenser which is a condenser-evaporator and is in flow connection with a top of the argon column, wherein the low-pressure column has an upper mass transfer region, a lower mass transfer region and a middle mass transfer region, wherein the middle mass transfer region has at least one first mass transfer space which is in fluid communication with the upper mass transfer region and is in fluid communication with the lower mass transfer region, wherein the upper mass transfer region has a liquid collector at a bottom end of the upper mass transfer region, wherein the first mass transfer space of the middle mass transfer region has a liquid distributor at a top of the first mass transfer space of the middle mass transfer region, wherein the argon column top condenser is arranged within the low-pressure column between the upper mass transfer region and the middle mass transfer region, and the argon column top condenser is a forced-flow evaporator, having a liquefaction space and an evaporation space, the evaporation space having an inlet at a bottom end of the evaporation space and an outlet at a top end of the evaporation space, and the outlet of the evaporation space is connected to the liquid distributor of the first mass transfer space of the middle mass transfer region, the system further comprising a conduit from the liquid collector beneath the upper mass transfer region to the inlet of the evaporation space of the argon column top condenser, whereby liquid from the liquid collector beneath the upper mass transfer region can flow into the evaporation space of the argon column top condenser, a vessel having an inlet and an outlet, a two-phase conduit which is connected to the outlet of the evaporation space of the argon condenser and to the inlet of the vessel, a gas conduit connected to the outlet of the vessel for drawing off gas from the vessel, said gas conduit including a control valve, and a liquid conduit from the vessel to the liquid distributor at the top of the middle mass transfer section, whereby liquid from the vessel can flow to the liquid distributor at the top of the middle mass transfer section.

2. The distillation column system according to claim 1, wherein the argon condenser produces a reflux stream for the argon column.

3. The distillation column system according to claim 1, wherein the argon column is a crude argon column and has 70 to 180 theoretical plates.

4. The distillation column system according to claim 1, wherein the middle mass transfer region is subdivided by a vertical dividing wall, in a gas-tight manner into the first mass transfer space and a second mass transfer space, the second mass transfer space forms at least part of the argon column and is not in fluid communication with the upper mass transfer region, and the second mass transfer space is in fluid communication with the lower mass transfer region.

5. The distillation column system according to claim 4, wherein the vertical dividing wall is a flat dividing wall.

6. The distillation column system according to claim 1, wherein the middle mass transfer region is subdivided by a vertical dividing wall, in a gas-tight manner into the first mass transfer space and a second mass transfer space, the argon column is formed solely by a separate crude argon column having a top and a bottom, the top of the separate crude argon column is in flow connection with the liquefaction space of the argon column top condenser, and the bottom of the separate crude argon column is in flow connection with the top of the second mass transfer space.

7. The distillation column system according to claim 1,
the argon column is formed solely by a separate crude argon column having a top and a bottom,
the top of the separate crude argon column is in flow connection with the liquefaction space of the argon column top condenser, and
the bottom of the argon column is in flow connection with an intermediate region of the low-pressure column,
wherein the intermediate region of the low-pressure column is a region between the middle transfer region and lower mass transfer region.

8. The distillation column system according to claim 1, wherein the conduit from the liquid collector beneath the upper mass transfer region to the inlet of the evaporation space of the argon column top condenser is configured
the conduit from the liquid collector beneath the upper mass transfer region to the inlet of the evaporation space of the argon column top condenser
so that at least 80 mol % of liquid that flows into the liquid collector beneath the upper mass transfer region flows into the evaporation space of the argon column top condenser.

9. The distillation column system according to claim 8, wherein the conduit from the liquid collector beneath the upper mass transfer region to the inlet of the evaporation space of the argon column top condenser is configured so that at least 90 mol % of liquid that flows into the liquid collector beneath the upper mass transfer region is introduced into the evaporation space of the argon column top condenser.

10. The distillation column system according to claim 6, further comprising a crude oxygen conduit from the bottom of the high-pressure column to the upper mass transfer region of the low-pressure column whereby crude oxygen can flow from the bottom of the high-pressure column to the upper mass transfer region of the low-pressure column.

11. A plant for production of oxygen by cryogenic fractionation of air, comprising
a main air compressor for compression of feed air,
an air precooling unit for precooling of the feed air compressed in the main air compressor,
an air cleaning unit for cleaning of the precooled feed air,
a main heat exchanger for cooling of cleaned feed air,
a first distillation column system according to claim 1,
a second distillation column system according to claim 1,
a first compressed air substream conduit from the main heat exchanger to the high-pressure column of the first distillation column system for introducing an air substream into said high-pressure column of the first distillation column system, and
a second compressed air substream conduit from the main heat exchanger to the high-pressure column of the second distillation column system for introducing an air substream into said high-pressure column of the second distillation column system.

12. The plant according to claim 11, wherein
the main heat exchanger is divided into a first group of heat exchanger blocks and a second group of heat exchanger blocks, which are connected in parallel so that feed air for the first distillation column system is passed exclusively through the first group, and feed air for the second distillation column system is passed exclusively through the second group, and
wherein the plant has a first overall product conduit for combination of a first product stream from the first distillation column system and a second product stream from the second distillation column system, and means of dividing the overall product stream from the overall product conduit between the first group and second group of the main heat exchanger.

13. The plant according to claim 11, wherein the first distillation column system and the second distillation column system are of the same installation size.

14. The plant according to claim 11, wherein for each of the first and second distillation column systems comprises a separate subcooling countercurrent heat exchanger, the subcooling countercurrent heat exchanger of the first distillation column system is operable independently of the subcooling countercurrent heat exchanger of the second distillation column system.

15. The plant according to claim 11, wherein the first and second distillation column systems are operable independently of one another.

16. The distillation column system according to claim 1, wherein
the middle mass transfer region is subdivided by a vertical dividing wall, in a gas-tight manner into the first mass transfer space and a second mass transfer space,
the argon column is formed from a combination of the second mass transfer space and a separate crude argon column having a top and a bottom, and
the top of the separate crude argon column is in flow connection with a lower end of the second mass transfer space and the second mass transfer is closed at the lower end toward the lower mass transfer region.

17. The distillation column system according to claim 1, wherein the vessel is arranged within the low-pressure column between the upper mass transfer region and the middle mass transfer region.

18. The distillation column system according to claim 4, wherein the vessel is arranged within the low-pressure column between the upper mass transfer region and the middle mass transfer region.

19. The distillation column system according to claim 6, wherein the vessel is arranged within the low-pressure column between the upper mass transfer region and the middle mass transfer region.

20. The distillation column system according to claim 16, wherein the vessel is arranged within the low-pressure column between the upper mass transfer region and the middle mass transfer region.

* * * * *